US005532804A

United States Patent [19]

Hirata et al.

[11] Patent Number: 5,532,804

[45] Date of Patent: Jul. 2, 1996

[54] DEVICE FOR DEVELOPING AN ELECTROSTATIC IMAGE ON AN IMAGE MEMBER

[75] Inventors: Kei Hirata; Tomoyoshi Chihara; Nobumasa Furuya; Takeshi Sumikawa, all of Kanagawa, Japan

[73] Assignee: Fuji Xerox Co., Ltd., Tokyo, Japan

[21] Appl. No.: 275,440

[22] Filed: Jul. 15, 1994

[30] Foreign Application Priority Data

Jul. 16, 1993 [JP] Japan ..... 5-197725

[51] Int. Cl.[6] ..... G03G 15/09

[52] U.S. Cl. ..... 355/251; 118/658

[58] Field of Search ..... 355/251, 253, 355/246; 118/656, 657, 658

[56] References Cited

U.S. PATENT DOCUMENTS 5,277,848 7/1993 Robinson et al. ..... 355/253
5,315,353 5/1994 Simazaki et al. ..... 355/251
5,325,161 6/1994 Saha et al. ..... 355/251

FOREIGN PATENT DOCUMENTS 56-144452 11/1981 Japan .
60-176069 9/1985 Japan .
61-141469 6/1986 Japan .
63-159868 7/1988 Japan .
63-278082 11/1988 Japan .
1-291268 11/1989 Japan .

*Primary Examiner*—R. L. Moses
*Attorney, Agent, or Firm*—Finnegan, Henderson, Farabow, Garrett & Dunner

[57] ABSTRACT

A developing device, which has a developer carrying member forming a magnetic brush of a two-component developer and is capable of carrying out a development while it is not in contact with an electrostatic latent image retaining member, is improved so as to reproduce an image at a sufficient image density.

18 Claims, 9 Drawing Sheets

31c
S N S N S N

DEVICE FOR DEVELOPING AN ELECTROSTATIC IMAGE ON AN IMAGE MEMBER

BACKGROUND OF THE INVENTION

The present invention relates to a developing device for visualizing an electrostatic latent image on an electrostatic latent image retaining member by attaching toner thereto, and more particularly to a developing device of the noncontact type in which a developing process is carried out using a two-component developer consisting of a mixture of nonmagnetic toner and magnetic carrier in a state that developer is not in contact with the electrostatic latent image retaining member.

An image forming apparatus, operable in both a black/white mode and a full color mode, is known in which, for developing a full color image, toner images of different colors are successively superposed on an electrostatic latent image retaining member, and the resultant color toner image is transferred on a paper through one-time image transfer. In this type of the image forming apparatus, a transfer drum with a recording paper held thereon, which receives, every color, toner images from the electrostatic latent image retaining member, is not used. Accordingly, this type of the image forming apparatus is advantageous in that the size and cost reduction is possible. For the developing device in use with such an image forming apparatus, there is proposed a developing device of the noncontact type in which a developer carrying member is disposed at a location where it faces an electrostatic latent image retaining member with a gap therebetween so that a toner image formed on the electrostatic latent image retaining member is not disarranged in a subsequent developing process. In the developing process, the developer on the developer carrying member is not brought into contact with the electrostatic latent image retaining member.

The developing device of the noncontact type comes in two categories: a developing device of one-component type, and a developing device of two-component type. In the first developing device, for the development, toner alone is magnetically or electrostatically held on the developer carrying member. In the second developing device, for the development, a two-component developer consisting of nonmagnetic toner and magnetic carrier is magnetically attracted to the developer carrying member. The developing device of the two-component type in which a two-component developer is used, an alternating electric field is generated in a developing area where the developer carrying member faces the electrostatic latent image retaining member, and the nonmagnetic toner is caused to fly by electric field, is superior to the developing device of the one-component type in image quality, image sustaining performance, and others.

Published Unexamined Japanese Patent Application No. Sho. 56-144452 (Japanese Patent Publication No. Hei. 2-4908) proposes two types of developing device for the developing device of the two-component and noncontact type. In the first developing device, the developer carrying member contains a magnetic pole, which is fixed at a location facing the developing area. A conductive sleeve, which is provided on the outer surface of the developer carrying member, is turned during the developing process. Thus, the developing process is carried out in an alternating electric field. In the second developing device, the developer carrying member contains two magnetic poles of the same polarity arranged juxtaposed. The developer carrying member is disposed such that a portion thereof between the magnetic poles faces the electrostatic latent image retaining member. With this arrangement, toner is easy to separate from the carriers during the developing process.

In the developing device of such a noncontact type, to obtain a sufficient development density, an intensive electric field must be formed in the developing area. To realize this, the conductive sleeve serving as an electrode must be put close to the surface of the developer carrying member within the limits of the possible. As described above, the first developing device locates one magnetic pole in the developing area. The second developing device juxtaposes two magnetic poles of the same polarity in the developing area so as to form two maximum values of the magnetic field of which the direction is vertical to the sleeve surface, and one minimum value of the magnetic field located between the two maximum values. Therefore, the developer is erected high in the developing area. As a result, it is difficult to keep the developer separated from the developer carrying member and to secure a density necessary for the development.

In view of this circumstance, proposals, which can keep the developer separated from the developer carrying member and secure the smallest gap between the electrostatic latent image retaining member and the sleeve, have been made in Published Unexamined Japanese Patent Application Nos. Hei. 1-291268, Sho. 60-176069 (Japanese Patent Publication No. 4-36383), and sho. 63-159868. The developing device described in Published Unexamined Japanese Patent Application No. Hei. 1-291268 proposes some unique techniques as follows. The pitch of the array of the magnetic poles in the developer carrying member is reduced. Saturation magnetization of the magnetic carriers of the two-component developer is reduced. In the electrostatic latent image retaining member, the circumference repulsion magnetic pole is disposed in opposition to the developing magnetic poles in the developer carrying member. With provision of the magnetic pole, the erection of the developer on the developer carrying member is reduced in height.

In the developing device disclosed in Published Unexamined Japanese Patent Application No. Sho. 60-176069 (Japanese Patent Publication No. 4-36383), a plural number of magnetic poles are disposed at such locations off the developing area in the developer carrying member. Magnetic poles of different polarities are disposed and fixed before and after the developing area. The developing process is carried out in a noncontact manner while only the sleeve on the outer surface of the developer carrying member is turned.

In the developing device disclosed in Published Unexamined Japanese Patent Application No. Sho. 63-159868, a magnetic field generating means is located within the developer carrying member. A magnetic field developed by the magnetic field generating means is shaped so that the magnetic field in the tangential direction on the surface of the developer carrying member has two maximum values of its intensity on both sides of at a portion where the developer carrying member is closest to the electrostatic latent image retaining member, and the minimum value of the intensity of the magnetic field in the tangential direction in the vicinity of the closest portion is at least 90% of the maximum value.

The developing devices disclosed in the above-mentioned publications have the problems to be described below.

The developing device described in Published Unexamined Japanese Patent Application No. Hei. 1-291268 succeeds in preventing the magnetic carriers from running in a line in the direction orthogonal to the surface of the developer carrying member, and hence in lessening the erection of the developer. Through the interaction of the magnetic fields developed by the repulsion magnetic poles of the electrostatic latent image retaining member and the developing magnetic poles, the erected developer lies down on the circumference of the developer carrying member. As a result, a portion where the developer is erected toward the electrostatic latent image retaining member is reduced. Toner issues mainly from the portion where the developer is erected toward the electrostatic latent image retaining member. Accordingly, if such a portion of the developer is reduced, a less amount of toner issues, so that the developing efficiency is reduced. For the magnetic pole pitches in the developer carrying member, the publications merely describes that the magnetic pole pitch of the second developing device group is shorter than that of the first developing device group, and the magnetic pole pitches of the third and subsequent developing devices are further shorter, and that, with the shortening of the magnetic pole pitch, the height of the erected developer can be reduced. And there is no description on the relationships of the magnetic pitches, the erection of the developer, and resultant developing characteristics.

In the developing device disclosed in Published Unexamined Japanese Patent Application No. Sho. 60-176069 (Japanese Patent Publication No. 4-36383), under the influence of the magnetic fields developed by the different magnetic poles disposed off the developing area, the magnetic carriers are attracted onto the developer carrying member in a state that it continuously runs on the circumference of the developer carrying member. The erected developer lies down. In this state, of the toner attracted to the erected developer, only the toner attracted to the surfaces of the erected developer, which face the electrostatic latent image retaining member, flies into the developing area, and contributes to the development. The resultant development density is unsatisfactory.

In the developing device disclosed in Published Unexamined Japanese Patent Application No. Sho. 63-159868, the force of restraining the magnetic carriers is reduced in the developing area. The erected developer lies down on the circumference of the developer carrying member. A less amount of toner contributes to the development, and a development density is insufficient.

With view of overcoming the disadvantages of the conventional art as mentioned above, the present invention has an object to provide a developing device of the noncontact type which reproduces an image at sufficient development density by using a two-component developer.

SUMMARY OF THE INVENTION

To solve the problems as mentioned above, there is provided a developing device in which a developer carrying member for magnetically attracting and transporting a two-component developer containing magnetic carriers and nonmagnetic toner is disposed facing an electrostatic latent image retaining member, an alternating electric field is formed in a developing area where the electrostatic latent image retaining member faces the developer carrying member, the nonmagnetic toner of the two-component developer, which is kept in noncontact with the developer carrying member, is transferred to the electrostatic latent image retaining member in the alternating electric field, thereby visualizing an electrostatic latent image formed thereon, characterized in that said developer carrying member includes a circumferential portion made of conductive material and a magnet having therein an array of magnetic poles of different polarities alternately and circumferentially arrayed at such a pitch that a plural number of the magnetic polarities are contained in the developing area.

The magnet of the developer carrying member may take any structure if a plural number of magnetic poles of different polarities are alternately arrayed in the developer carrying member, and the magnet is uniformly magnetized in the axial direction of the developer carrying member. The pitch of the magnetic pole array may be properly selected depending on the type of developer used, the distance between the developer carrying member and the electrostatic latent image retaining member, and the like.

The magnet may be magnetized so that the magnetic poles of different polarities are alternately arrayed a part (including the developing area) of the circumference of the developer carrying member or the entire circumference thereof, and may take any structure.

The magnetic pole pitch is established such that more than two magnetic poles are arrayed in the effective developing area. It is preferable that the magnetic pole pitch is larger than a distance between the surface of the magnetic pole and the surface of the sleeve forming the developer carrying member. The distance between the surface of the magnetic pole and the surface of the sleeve forming the developer carrying member is defined by summing a distance between the surface of the magnetic pole and the inner surface of sleeve and a thickness of the sleeve. If the magnetic pole pitch is smaller than this distance, the magnetic force lines due to the magnetic poles hardly go out of the surface of the sleeve, and the transportability of the developer remarkably deteriorates. It is preferable that a plural number of magnetic poles, preferably more than three magnetic poles, are arrayed in the effective developing area. For example, if a distance between the fixed magnetic pole and the sleeve is established to be about 1 mm considering a rotating preciousness of the sleeve and the thickness of sleeve is established to be about 1 mm, the magnetic pole pitch is preferably established to be more than 2 mm.

The circumferential portion allows an AC voltage that is superposed on the DC voltage to be applied to between the developer carrying member and the electrostatic latent image retaining member. The circumferential portion may be a conductive sleeve as a hollowed tubular member, a conductive layer layered on the surface of the magnet, or the like. The conductive member and the magnet may be combined such that the conductive member and the magnet are stuck together and turned in unison, the sleeve is turned while the magnet is fixed, or the conductive member and the magnet are independently turned.

The developing area means an effective developing area. When an alternating electric field equal to that applied at the time of development is applied to this area in a state that the developer carrying member and the electrostatic latent image retaining member are both at a standstill, toner flies to an electrostatic latent image on the electrostatic latent image retaining member. The width of the developing area, when measured, may be expressed in the unit of mm.

In the developing device thus constructed, the magnet magnetized such that a plural number of magnetic poles of different polarities are alternately and circumferentially arrayed is disposed at a location facing the electrostatic latent image retaining member within the developer carrying member. In the magnetic field formed by the plural number of magnetic poles, magnetic lines of force are connected by the adjacent magnetic poles. As a result, the erection of the developer that is caused by the magnetic field is reduced in height. The developer is erected toward the electrostatic latent image retaining member at the locations of the plural number of magnetic poles in the developing area. In this area, toner flies from the tips of the erected developer and a portion near the developer carrying member toward the electrostatic latent image retaining member, and develops the latent image thereon.

Thus, the developer is erected at a plural number of locations in the developing area, so that the amount of developer contributing to the development is remarkably increased. The developing efficiency is increased and a satisfactory developing density is secured. Since the erection of the developer is low, the gap between the developer carrying member and the electrostatic latent image retaining member may be set narrow. As a result, the electric field in the developing area is intensive. The developing efficiency is increased and a satisfactory developing density is secured.

BRIEF DESCRIPTION OF THE DRAWINGS

FIG. 7 is diagram showing another example of a magnetic pole array formed in the developer carrying member, which is used in the developing device of the third embodiment.

DETAILED DESCRIPTION OF THE PREFERRED EMBODIMENTS

The preferred embodiments of the present invention will be described with reference to the accompanying drawings.

Figure 2:
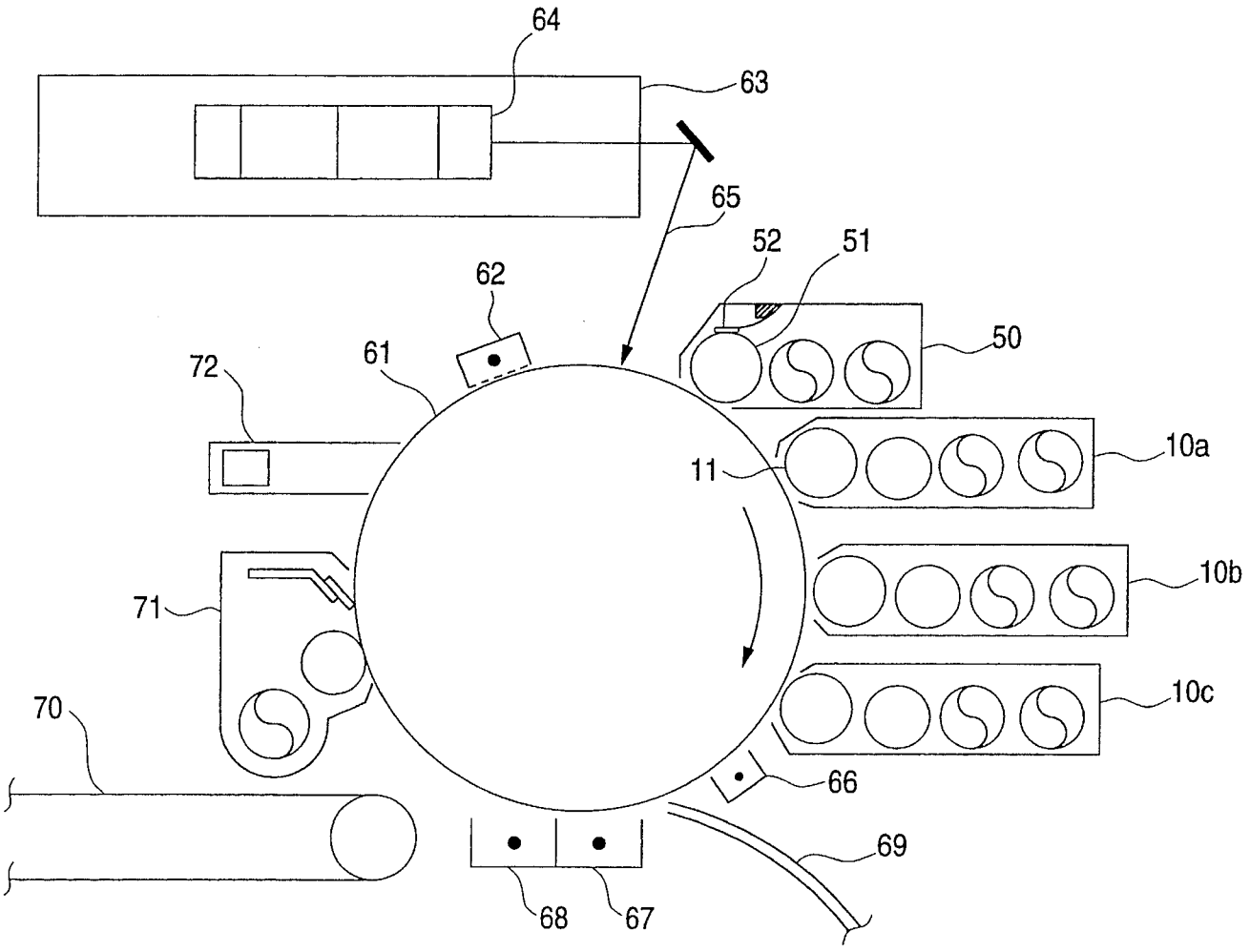
FIG. 2 is sectional view showing an image forming apparatus incorporating the developing device of FIG. 1.

FIG. 2 shows a schematic diagram of a color image forming apparatus incorporating developing devices 10*a*, 10*b*, and 10*c* of the noncontact/two-component type according to a first embodiment of the present invention.

In the color image forming apparatus, as shown, one developing device 50 of the magnetic one-component type, three developing devices 10*a*, 10*b*, and 10*c*, and a charger 62 are disposed around a tubular, electrostatic latent image retaining member 61. The developing device 50 is for black, and the developing devices 10*a*, 10*b*, and 10*c* are for yellow, magenta, and cyan.

The tubular, electrostatic latent image retaining member 61 is charged by the charger 62, and a latent image corresponding to a black image is formed on a predetermined area of the electrostatic latent image retaining member 61 by means of a laser beam 65, which is emitted from a laser beam emitter 63 containing a semiconductor laser and a polygonal rotary mirror 64. The laser beam writes an image on the surface of the electrostatic latent image retaining member 61, and the laser-beam irradiated portion of the electrostatic latent image retaining member 61 is developed with the toner charged with the same polarity as that of the surface potential of the electrostatic latent image retaining member 61 that is charged by the charger 62.

In the black developing device 50, magnetic one-component toner is attached to a developer carrying member 51, which is disposed confronting with the electrostatic latent image retaining member 61. The toner attached thereto is formed into a thin layer, and charged so as to have a potential necessary for the development. Thereafter, the toner layer is transferred to a location where it faces the electrostatic latent image retaining member 61. In the electric field by an AC bias voltage containing a DC component on which an AC voltage is superposed, toner flies to the electrostatic latent image retaining member 61, thereby developing the latent image thereon.

In a second cycle of the developing process, the electrostatic latent image retaining member 61 is charged again by the charger 62. A portion on the surface of the charger 62 the potential on which was reduced by the irradiation of the laser beam 65 in the previous developing cycle (for forming the black image), is charged again up to a potential substantially equal to the original potential. Thereafter, a laser beam 65 emitted from the laser beam emitter 63 depicts a light image (corresponding to a yellow image) on a predetermined area of the surface of the electrostatic latent image retaining member 61. Then, the yellow developing device 10*a* develops the light image (in the portion irradiated with the laser beam) with yellow toner that is charged with the same polarity as that of the surface potential of the electrostatic latent image retaining member 61. The yellow developing device 10*a* is a developing device of the noncontact type in which a two-component developer containing nonmagnetic toner and magnetic carriers is used, and toner flies into an alternating electric field. In the yellow developing device 10*a*, the quantity of transferred developer, the air gap, and AC electric field conditions are optimized so as not to disarrange the toner image on the electrostatic latent image retaining member 61 that was developed in the previous developing cycle by the black developing device 50, and not to return the toner image on the electrostatic latent image retaining member 61 to the developing device 10*a*. The details of the yellow developing device 10*a* will be described later.

Similarly, a third developing cycle is executed which contains the recharge of the electrostatic latent image retaining member by the charger 62, the formation of a light image corresponding to a magenta image by the laser beam emitter 63, and the development of the magenta image by the magenta developing device 10*b*. Then, a fourth developing cycle is executed which contains the recharge of the electrostatic latent image retaining member by the charger 62, the formation of a light image corresponding to a cyan image by the laser beam emitter 63, and the development of the cyan image by the cyan developing device 10*c*. In the magenta and cyan developing devices 10*b* and 10*c* as in the yellow developing device 10*a*, the quantity of transferred developer, the air gap, and AC electric field conditions are optimized so as not to disarrange the toner images on the electrostatic latent image retaining member 61 that were developed in the previous developing cycles by the developing devices, and not to return the toner images on the electrostatic latent image retaining member to the developing devices 10*b* and 10*c*.

At a time point that the development of the cyan image by the developing device 10*c* is completed, color toner images of black, yellow, magenta, and cyan, which are superposed one on another, lie on the electrostatic latent image retaining member 61.

These toner images and the electrostatic latent image retaining member 61, if required, undergo the irradiation by a pre-transfer charger 66 to be charged or discharged to an optimum state for image transfer, and these images of four colors are transferred onto a transfer paper, which comes in while being guided by a paper guide 69, through one process for image transfer.

After completion of the transfer process, the transfer paper is discharged by a detach charger 68, peeled off the electrostatic latent image retaining member 61, and transported to a fixing stage (not shown) by a transport belt 70.

Following the transfer process, residual toner on the electrostatic latent image retaining member 61 is removed therefrom by a cleaning unit 71. The electrostatic latent image retaining member is exposed to light from a discharge/exposure unit 72, and charged again by the first charger. Then, it undergoes again the above-mentioned developing process consisting of four developing cycles. The machine produces a plural number of prints in a successive order.

With the assist of an eccentric cam or a crank mechanism incorporated into the cleaning unit 71, the cleaning unit is placed in a contact state that the whole unit is in contact with the electrostatic latent image retaining member 61 and in a retract state that it is retracted from the electrostatic latent image retaining member 61.

With this function of the cleaning unit 71, the cleaning unit 71 is placed in a retract state that it is separated from the electrostatic latent image retaining member 61 during the process of forming toner images on the electrostatic latent image retaining member 61. The cleaning unit 71 is placed in a contact state immediately before the leading edge of the portion on which the toner image of the fourth color (cyan) is superposed for development, after undergoing the image transfer process, reaches the cleaning stage, after the trailing edge of the portion on which toner image of the third color (magenta) is superposed for development, passes a location when it faces the cleaning unit.

The developing devices 10*a*, 10*b*, and 10*c* according to the first embodiment of the present invention, which is incorporated into the above-mentioned image forming apparatus, will be described.

Figure 1:
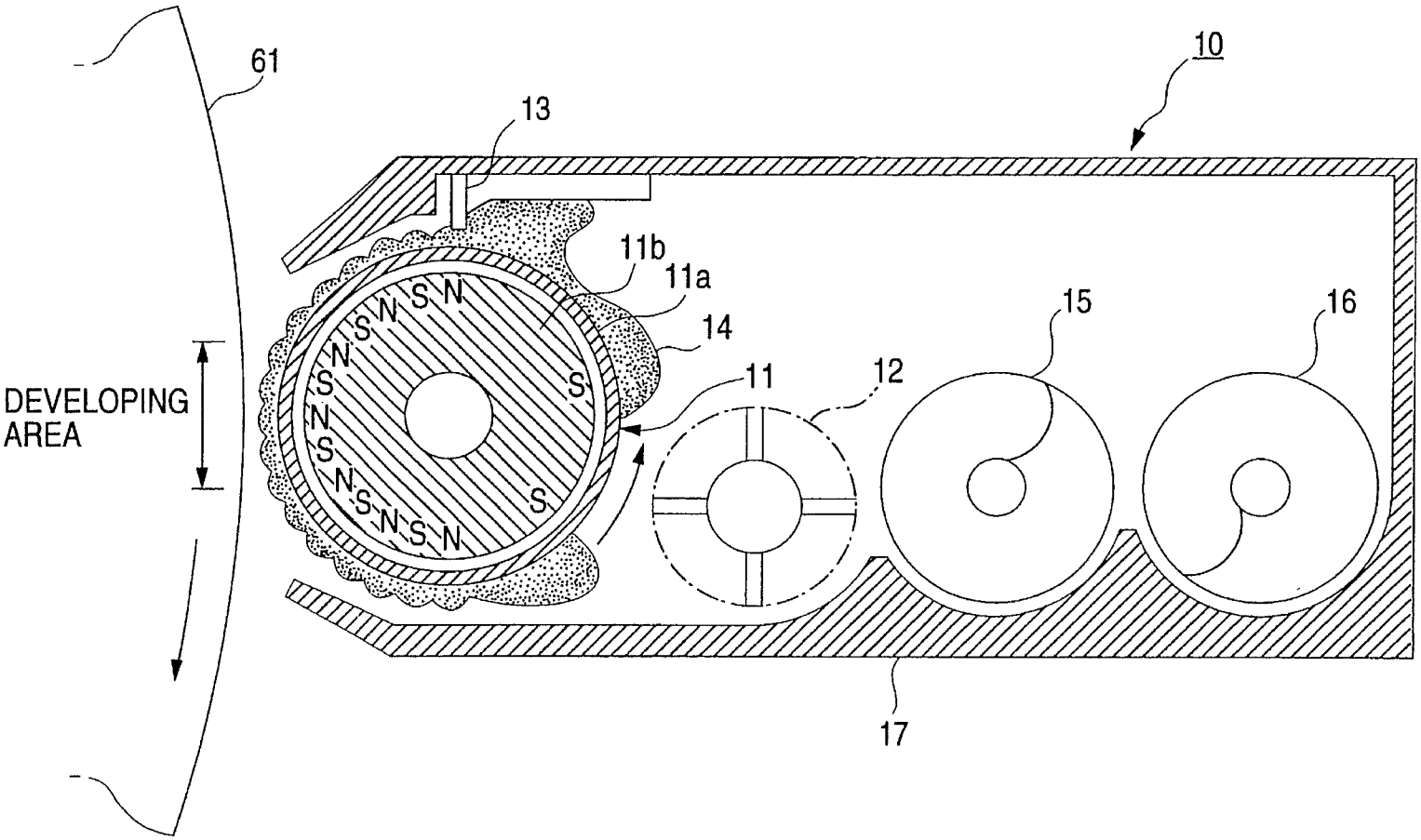
FIG. 1 is cross sectional view showing a developing device according to a first embodiment of the present invention.

FIG. 1 is a schematic diagram showing the developing device 10.

The developing device 10, as shown in FIG. 1, is made up of a developer carrying member 11, a developer regulating member 13, a paddle 12, and developer agitating members 15 and 16. The developer carrying member 11 is disposed within a housing 17 for containing a two-component developer 14 consisting of nonmagnetic toner and magnetic carriers, while facing the electrostatic latent image retaining member 61, and forms a magnetic brush for the developer by magnetically attracting the two-component developer to the surface thereof. The developer-regulating member 13 functions to regulates an amount of the two-component developer attracted onto the developer carrying member 11. The paddle 12 supplies the two-component developer to the surface of the developer carrying member 11. The developer agitating members 15 and 16, located adjacent to the paddle 12, agitate the two-component developer while transporting the developer in the axial direction.

The electrostatic latent image retaining member 61 is supported by the main body of the color image forming apparatus. When a light image is depicted on the surface of the electrostatic latent image retaining member, different surface potentials are caused on the surface thereof, thereby forming an electrostatic latent image thereon.

The developer carrying member 11 as a hollowed tubular member made of magnetic material includes a sleeve 11*a* with a conductive surface, and a magnet 11*b* with a plural number of magnetic poles fixedly supported within the sleeve 11*a*. Only the sleeve 11*a* is driven to rotate in a given direction. The sleeve 11*a* is designed to have the outer diameter of 25 mm and the surface roughness Rz of 20 μm (Rz= 20 μm). The magnet 11*b* is constructed such that N and S poles are alternately arrayed along a portion of the outer surface thereof which faces the electrostatic latent image retaining member 61 so that flux densities of 450 Gauss as a peak value are distributed at the pitches of approximately 2.5 mm on the surface of the sleeve. To form two repulsion magnetic poles, two locations near to both ends of a portion of the outer surface of the developer carrying member, which faces the paddle 12, are magnetized to have the same polarity S. The magnet 11*b* may be formed by magnetizing a magnetic tubular member and attaching a shaft to the magnetized tubular member, magnetizing a magnetic tubular member with a shaft, or winding a tubular support with a shaft by a magnetized sheet-like member. Alternatively, it may be formed by inlaying magnetized pieces in a magnetic tubular member.

The developer carrying member 11 is supported so that a gap between the surface of the sleeve 11*a* and the electrostatic latent image retaining member 61 is 500 μm. Under the magnetizing conditions set up as mentioned above, the erection of the developer is approximately 350 μm high on the sleeve 11*a*. The developer used in the present embodiment is formed by mixing magnetic carriers of 40 μm in weight average particle diameter and 60 emu/g in saturation magnetization into polyester color toner of 7 μm in weight average particle diameter, and agitating the mixture. The developer is adjusted so that a mixture ratio of toner in the developer is approximately 10 weight %, and the charge quantity of toner is 12 to 25 μc/g at relative humidity of 30% to 85%.

In the developing device thus constructed, a bias voltage containing a DC component and an AC component superposed on the DC component is applied from a bias source (not shown) to between the electrostatic latent image retaining member 61 and the sleeve 11*a*. An effective developing area is formed on the opposed portions of them by an alternating electric field caused in the gap between them.

The width of the effective developing area depends on the electric field condition, as a matter of course. Generally, it becomes wider as an electric field of the DC component is larger and an electric field of the AC component is larger. Further, the developer used in the present embodiment is also affected by a frequency of the AC component. Within a frequency range up to more than ten kHz, the effective developing area is the widest in the region of 1 to 3 kHz.

As described above, any means must be taken so as not to disturb the toner images developed on the electrostatic latent image retaining member 61. To this end, the following conditions are preferably set up: a dark potential on the electrostatic latent image retaining member 61 is 600 to 900 V; a bright potential, 50 to 200 V; a potential difference between the dark potential and the DC component of the bias voltage applied to the sleeve 11*a*, 50 to 150 V; the peak value of the AC component of the bias voltage, 1.5 to 2 kV; and a frequency of the AC component preferable for the development ranges from 4 to 10 kHz. When those conditions are satisfied, the width of the effective developing area is approximately 10 mm.

The operation of the developing device thus constructed will be described. The nonmagnetic toner in the two-component developer mixed and agitated by the developer agitating members 15 and 16 is charged to have a proper quantity of charge. With rotation of the paddle 12, the two-component developer is fed to the surface of the developer carrying member 11. The magnet 11*b* with a plural number of magnetic poles is provided in the developer carrying member 11. The magnetic carriers with nonmagnetic toner attached thereto are attracted to the surface of the sleeve in a continuous fashion. As a result, a layer of the two-component developer 14 is formed on the surface of the sleeve. With rotation of the sleeve 11*a*, the layer of the two-component developer passes the developer regulating member 13 where the quantity of the attracted developer is regulated, and is transported to the developing area where S and N poles are alternately arrayed within the sleeve 11*a*.

When the layer reaches the developing area, a plural number of erections of the developer are formed at the locations corresponding to the plural number of the magnetic poles and transported with the rotation of the sleeve 11*a*. When the erected developer pass the developing area, the toner of the two-component developer issues therefrom and flies to the electrostatic latent image retaining member by the alternating electric field existing between the developer carrying member 11 and the electrostatic latent image retaining member 61. As a result, a latent image on the electrostatic latent image retaining member is developed with the toner. The formation of the plural number of the erections of the developer brings about many useful effects. The developing efficiency is improved. The developing characteristics are excellent, and the development density is satisfactory. The image quality may be designed at a high design freedom. In the present embodiment, what is brought into contact with the developer carrying member is only the developer. Therefore, the developer carrying member will suffer from no abrasion. The developing device of the invention is suitably applicable to an apparatus of the type in which a high durability is required for the developer carrying member, such as a high speed image forming apparatus.

Figure 3:
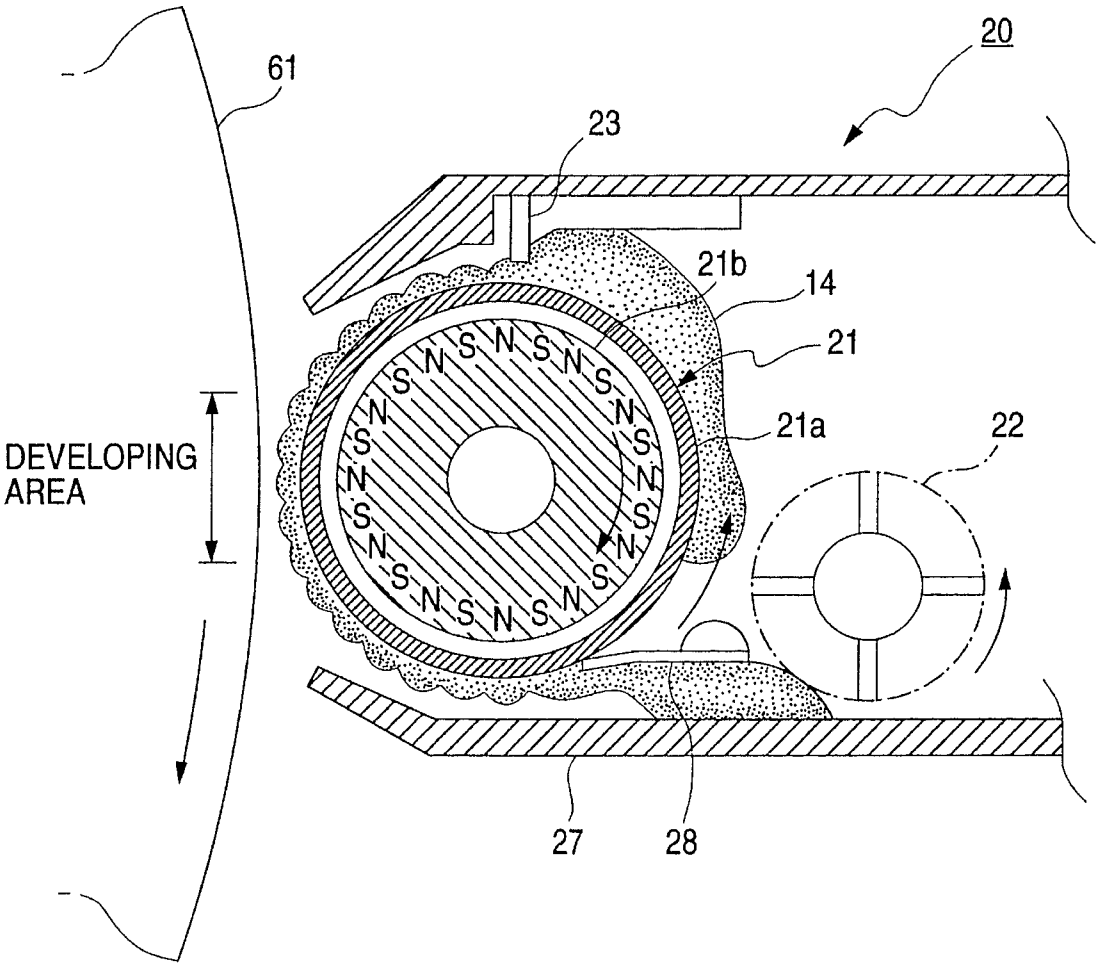
FIG. 3 is cross sectional view showing a developing device according to a second embodiment of the present invention.

FIG. 3 is an enlarged view showing the construction of a developer carrying member 21 used in a developing device according to a second embodiment of the present invention. In the developing device 20, the developer carrying member 11 of the first embodiment is substituted by the developer carrying member 21 including a hard, conductive sleeve 21*a* as a nonmagnetic, hollowed tubular member, and a magnet 21*b* located within the sleeve 21*a*. The entire circumference of the magnet is magnetized to have N and S poles alternately arrayed along the entire circumference of the developer carrying member. A developer peel-off member 28 is disposed upstream of a portion where a paddle 22 is opposed to the developer carrying member 21 when viewed in the direction of the rotation of the sleeve 21*a*.

In the developer carrying member 21, the sleeve 21*a* and the magnet 21*b* are both rotatable in the opposite directions as indicated by arrows.

The magnet 21*b* is magnetized so that N and S poles are alternately arrayed along the substantially entire circumference thereof. With such a magnetization of the magnet 21*b*, the plural number of magnetic poles arrayed at pitches of approximately 2.5 mm appear on the sleeve surface, and the flux density is approximately 450 Gauss at the locations of the maximum flux density on the surface of the sleeve.

The developer peel-off member 28 includes a plate-like member arranged such that one end of the plate-like member is supported by a housing 27 and the other end thereof is extended in the direction opposite to that of the rotation of the sleeve 21*a* and is pressed against the surface of the sleeve 21*a*. The developer peel-off member 28 functions to remove the toner still left on the developer carrying member 21 after the development process.

The other portions of the construction of the developing device 20 are substantially the same as that of the developing device 10 of the first embodiment.

In the developing device thus constructed, developer 14 dipped up with the paddle 22 is regulated to be a thin layer by a developer regulating member 23, and transported to the effective developing area. The developer still left after the developing process is peeled from the developer carrying member 21 with the developer regulating member 23, and mixed with the developer stored in the housing 27, and the mixture is agitated by the paddle 22.

Also in the developing device of the second embodiment, the developer erections were 350 μm high and the effective developing area was approximately 10 mm wide. Accordingly, the developing characteristics are excellent, and the image quality may be designed at a high design freedom.

In the second embodiment, the developer regulating member 23 is in contact with the surface of the sleeve 21*a*. Because of this, the developer carrying member is less durable than that in the first embodiment. Further, the method to drive the developer carrying member is complicated. However, the developing efficiency is improved because the sleeve 21*a* is moved relative to the magnet 21*b*, and a portion of the sleeve where the developer is erected is moved in the effective developing area. Accordingly, a design freedom is increased in the image quality design. The developing device of this embodiment is applicable to an image forming apparatus designed especially for forming images of high quality.

Figure 4:
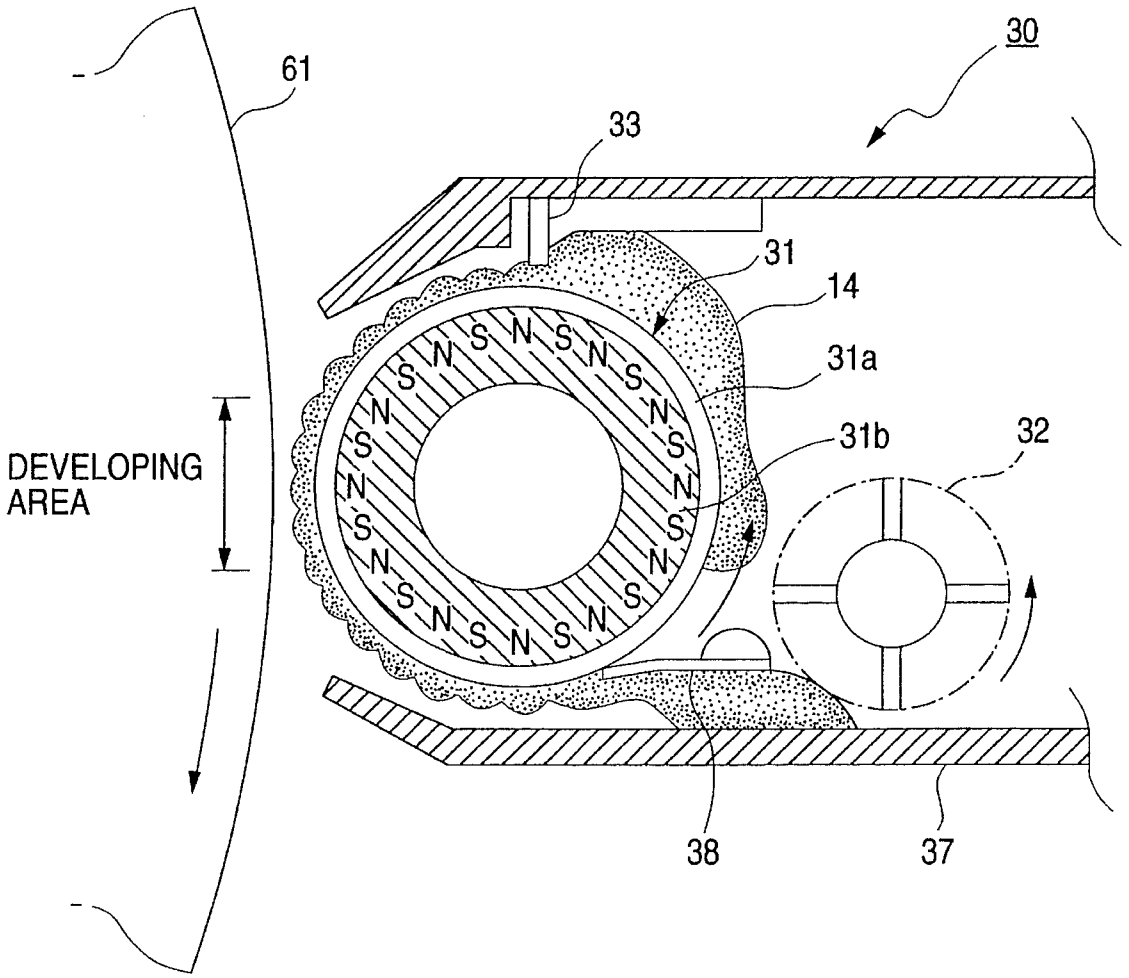
FIG. 4 is cross sectional view showing a developing device according to a third embodiment of the present invention.

FIG. 4 is a partially enlarged view showing the construction of a developer carrying member used in a developing device according to a third embodiment of the present invention.

In a developing device 30 of this embodiment, the developer carrying member 21 in the developing device 20 of the second embodiment is substituted by a developer carrying member 31 constructed such that a conductive sleeve 31*a* and a magnet 31*b* contained therein are stuck together, and these are turned together in a fixed direction.

The conductive sleeve 31*a* forming the developer carrying member 31 is a hard, conductive, nonmagnetic, hollowed tubular member. The magnet 31*b* is magnetized so that N and S poles are alternately arrayed along the substantially entire circumference thereof. With such a magnetization of the magnet 31*b*, the plural number of magnetic poles arrayed at pitches of approximately 2.5 mm appear on the sleeve surface, and the flux density is approximately 450 Gauss at the locations of the maximum flux density on the surface of the sleeve.

Figure 6:
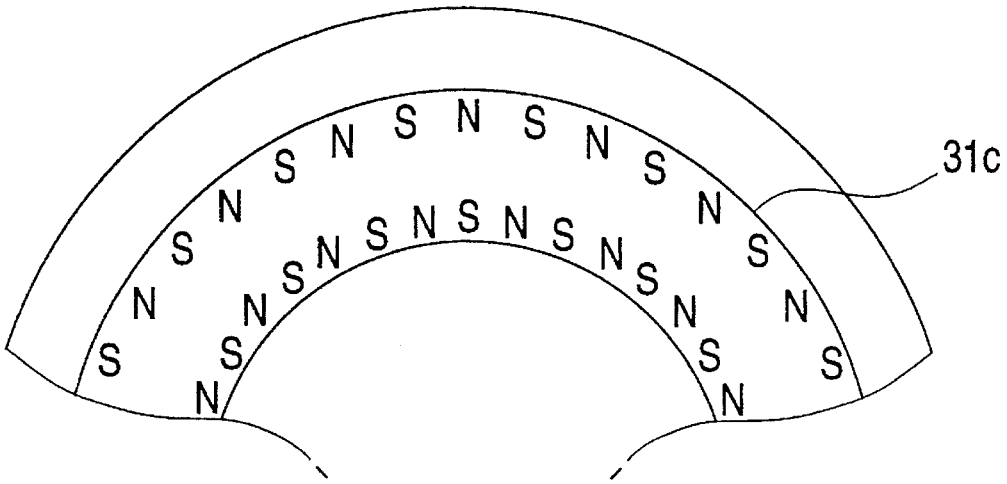
FIG. 6 is diagram showing an example of a magnetic pole array formed in the developer carrying member, which is used in the developing device of the third embodiment.

The magnet 31*b* may be constructed by sticking a magnetized sheet-like member to a tubular member, or attaching magnetic pieces to a sheet-like magnetic member. For the circular array of magnetic poles, a magnet 31*c* as shown in FIG. 6 may be used. In the magnetic 31*c*, different magnetic poles are alternately arrayed on both sides (obverse and reverse sides) of the magnet. A magnet 31*d* as shown in FIG. 7 may also be used. In the magnet 31*d*, different magnetic poles are alternately arrayed on only the obverse side of the magnet. The magnet may be a tubular member to be fit into the sleeve, not the sheet-like member.

The other portions of the construction of the developing device 30 are substantially the same as those of the developing device 20 in the second embodiment.

Figure 5:
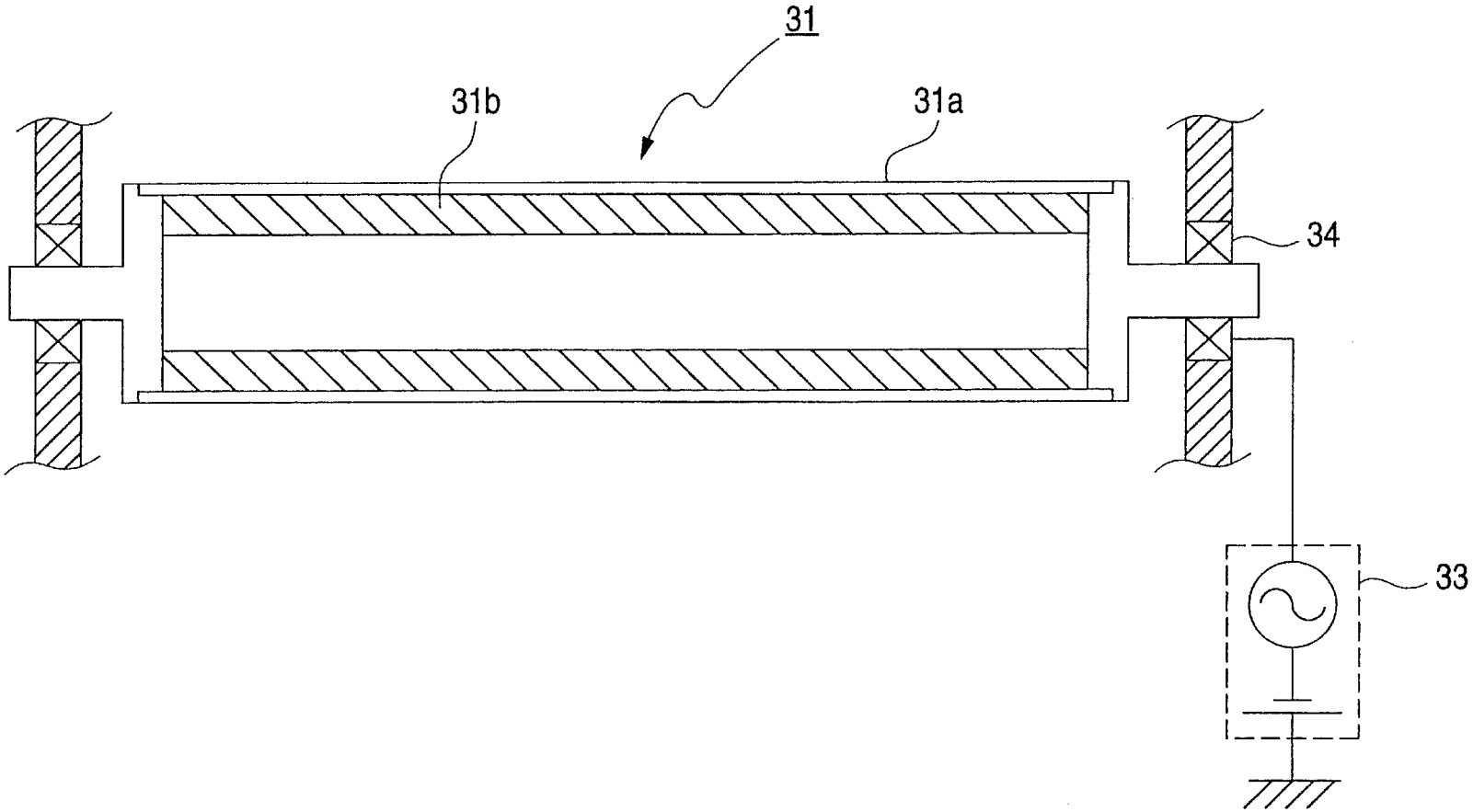
FIG. 5 is longitudinal sectional view showing a developer carrying member used in the developing device of the third embodiment.

In the developing device 30 thus constructed, the developer erection is 350 μm. A distance between the electrostatic latent image retaining member 61 and the conductive sleeve 31*a* is 500 μm. The conditions for the dark/bright potential of the electrostatic latent image and the alternating electric field are the same as those for the developing device of the first embodiment. The width of the effective developing area is approximately 10 mm. A bias voltage for forming an alternating electric field, as shown in FIG. 5, is applied from a bias source 33 through a bearing 34 to the conductive sleeve 31*a*.

The developing device of the present embodiment can also achieve excellent developing characteristics, and a designer can design the image quality at a high design freedom.

In the developing devices 10 and 20 of the first and second embodiments, it is necessary to drive the surface portion of the developer carrying member and the magnet independently. On the other hand, in the developing device 30 of the present embodiment, there is no need of driving them independently. Because of this, the construction of the developer carrying member is simple.

Since the sleeve and the magnet are stuck together into a unitary form, it is easy to intensity the magnetic field on the sleeve surface. When the magnet is constructed to be relatively thin, the outer diameter of the developer carrying member and the size of the developing device may be reduced. For the above two reasons, the developing device of the present embodiment is suitably applied to the image forming apparatus of low price model.

A developer carrying member similar in construction to that in the developing device of the third embodiment was constructed for the purpose of testing. The tested developer carrying member was specified as follows. The outer diameter of the sleeve was 20 mm. The pitch of the circular array of S and N poles on the sleeve surface was approximately 2 mm. The flux density on the sleeve surface was 450 Gauss. The test results showed that the performance of the tested developer carrying member was comparable with that of the developer carrying member of which the sleeve is 25 mm in outer diameter.

Figure 8:
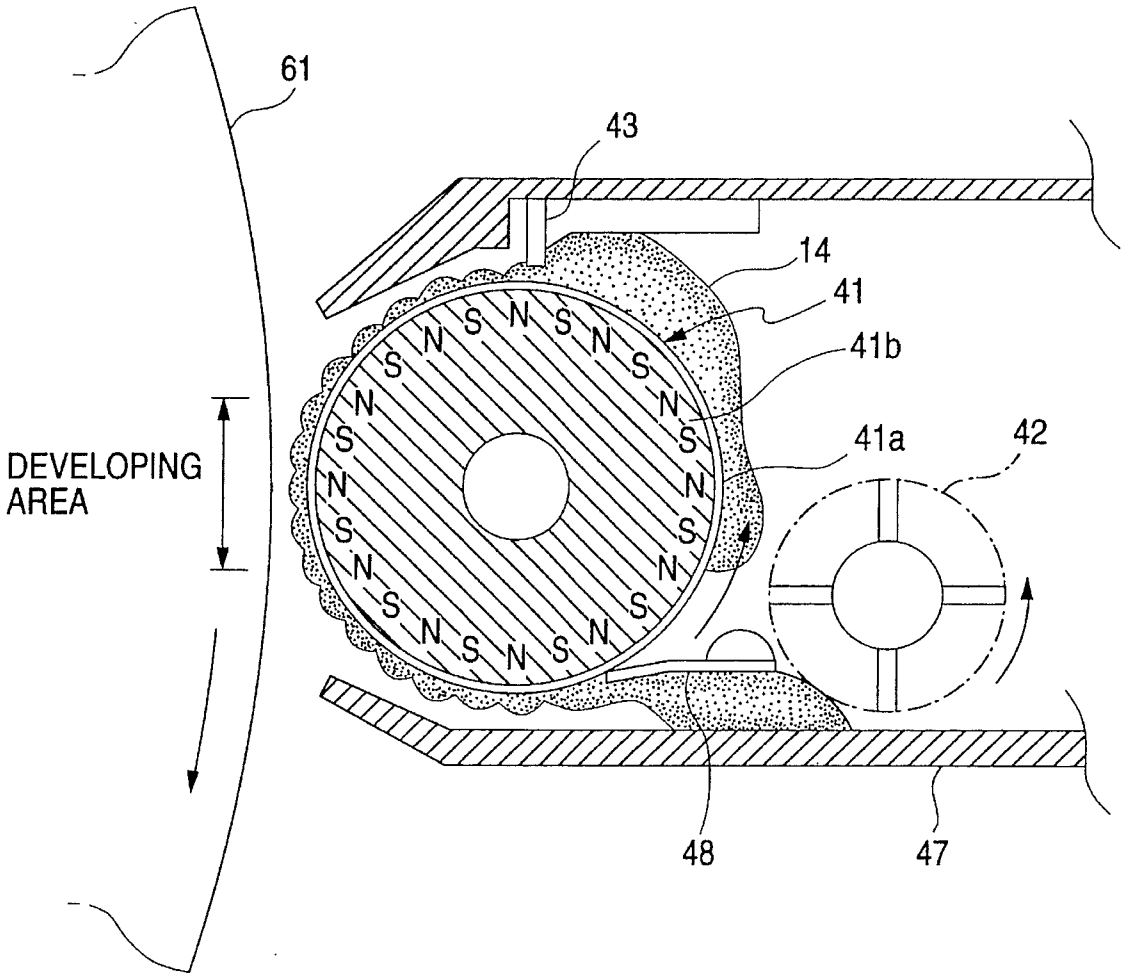
FIG. 8 is cross sectional view showing a developing device according to a fourth embodiment of the present invention.

FIG. 8 is a partially enlarged view showing the construction of a developer carrying member used in a developing device according to a fourth embodiment of the present invention.

In a developing device 40 of this embodiment, the developer carrying member 31 in the developing device of the third embodiment is substituted by a developer carrying member 41 formed of a conductive layer 41*a* and a magnet 41*b*. The conductive layer 41*a* is stuck fast onto the outer surface of the magnet 41*b*.

The outer diameter of the developer carrying member 41 is 25 mm, and the surface roughness Rz thereof is 4 μm (Rz=4 μm). The magnet 41*b* is magnetized so that N and S poles are alternately arrayed along the substantially entire circumference thereof. With such a magnetization of the magnet 41*b*, the plural number of magnetic poles arrayed at pitches of approximately 2.5 mm appear on the surface of the developer carrying member, and the flux density is approximately 450 Gauss at the locations of the maximum flux density on the surface of the developer carrying member.

Figure 9:
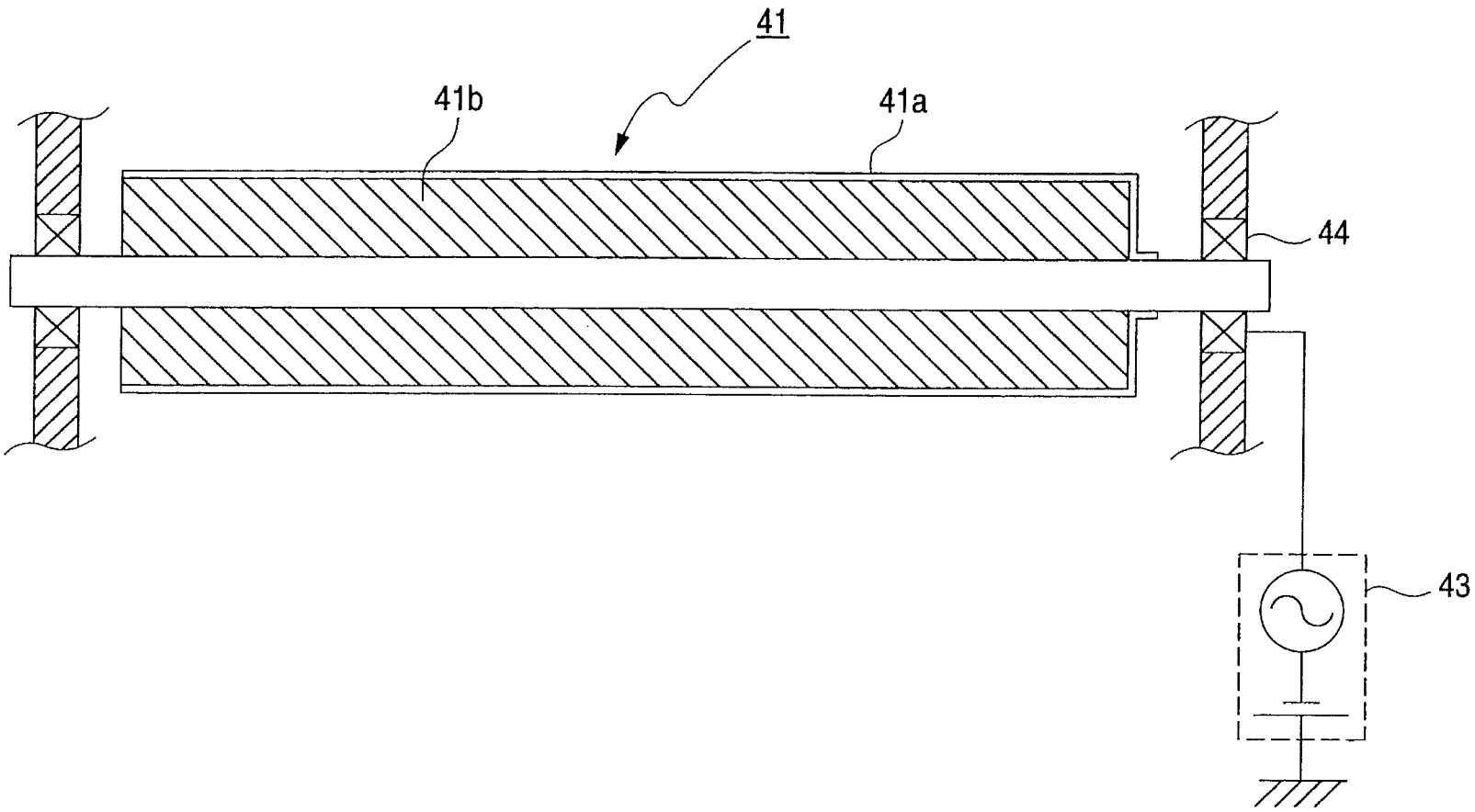
FIG. 9 is longitudinal sectional view showing a developer carrying member used in the developing device of the fourth embodiment.

In the developing device 40 thus constructed, the developer erection is 350 μm. A distance between the electrostatic latent image retaining member 61 and the developer carrying member 41 is 500 μm. The conditions for the dark/bright potential of the electrostatic latent image and the alternating electric field are the same as those for the developing device of the third embodiment. The width of the effective developing area is approximately 10 mm. A bias voltage for forming an alternating electric field, as shown in FIG. 9, is applied from a bias source 43 to the surface of the developer carrying member, through a bearing 44 and the conductive layer 41*a*.

The other portions of the construction of the developing device 40 are substantially the same as those of the developing device 30 in the third embodiment.

The developing device 40 of the present embodiment can also achieve excellent developing characteristics, and a designer can design the image quality at a high design freedom.

Figure 10:
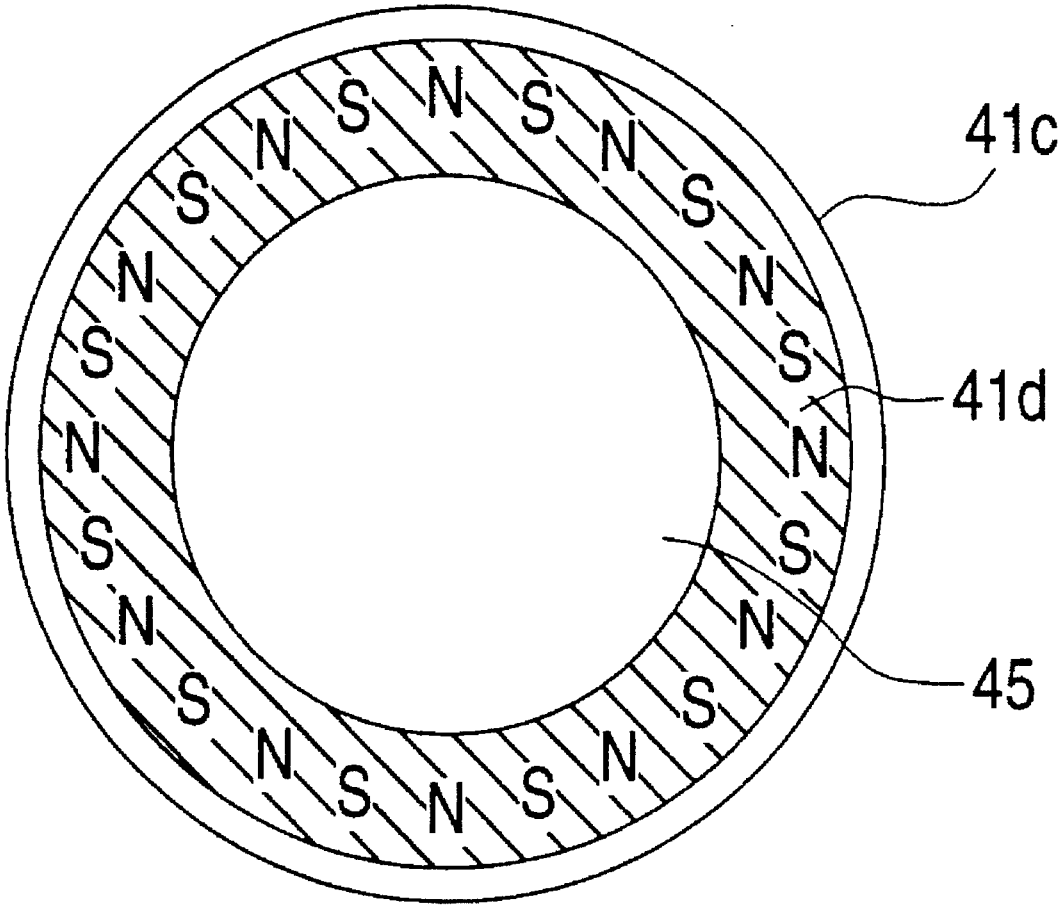
FIG. 10 is longitudinal sectional view showing another developer carrying member used in the developing device of the fourth embodiment.

The developer carrying member may be constructed such that a magnetized, plate-like magnet 41*d* is wound around a metal shaft 45, and a conductive layer 41*c* is formed on the outer surface of the magnet 41*d*, as shown in FIG. 10. The developer carrying member thus constructed was manufactured for the testing purpose. The diameter of the shaft was 8 mm. The plate-like magnet of 2 mm thick was magnetized so that N and S poles are alternately arrayed at pitches of 2 mm along the substantially entire circumference thereof. The plate-like magnet was wound around the shaft. A conductive layer was formed on the surface of the magnet. The test results showed that the performance of the tested developer carrying member was comparable with that of the developer carrying member of 25 mm in outer diameter.

In the developing device 40 of the present embodiment, the conductive layer on the surface of the developer carrying member has a lower rigidity than the developer carrying member 31 of the third embodiment. The lifetime of the developer carrying member is correspondingly reduced. However, the size and cost of the developing device may be reduced. Accordingly, the developing device of this embodiment is suitable for a low-grade image forming apparatus of the cartridge type in which developer is replaced every developing device.

The criteria for selecting the pole-to-pole distance in the magnetic poles array of the magnet, the surface roughness of the developer carrying member, numerical characteristics, such as magnetic characteristics, and the like, which are used in the first to fourth embodiments, will be described.

* Pole-to-Pole Distance of the Magnet

The distance between the adjacent magnetic poles of the those S and N magnetic poles alternately arrayed will be described. Generally, the height of the erected developer becomes lower as the pole-to-pole distance becomes shorter when considered under the condition of the same magnetic flux. Accordingly, where the pole-to-pole distance is short, the distance between the developer carrying member and the electrostatic latent image retaining member may be reduced. Accordingly, in the developing device of the noncontact type in which a two-component developer is used and toner is caused to fly in an alternating electric field, the electric field may be intensive. Under the condition that a magnetic pole has a fixed flux density on the surface of the developer carrying member, if the pole-to-pole distance is reduced, the magnetic lines of force concentrate at a location near to the surface of the developer carrying member. The result is the reduction of the magnetic force acting on the electrostatic latent image retaining member. The reason for this also relates to the reason for the reduction of the height of the erected developer. The reduction of the pole-to-pole distance brings about such an advantage that the magnetic toner may easily be used in the previous image forming process. However, when the developer commercially available at the present stage is used, if the pole-to-pole distance is too narrow, an insufficient quantity of transported developer is secured and the resultant image is poor in density. Further, the magnetic field of the magnet becomes small in intensity, resulting in dispersion of carriers. For this reason, the pole-to-pole distance of 0.5 mm or shorter is impractical. A preferable pole-to-pole distance is at least 1 mm for the developer used in the above-mentioned embodiments.

When the pole-to-pole distance is large, the height of the erected developer is increased. The increased height of the erected developer hinders the reduction of the distance between the developer carrying member and the electrostatic latent image retaining member. Therefore, the large pole-to-pole distance is unfavorable to the attempt to use an intensive electric field. In this case, however, the quantity of transported developer may be increased. The pole-to-pole distance practically preferable is approximately 10 mm at maximum. The case of the pole-to-pole distance of 10 mm as mentioned above is for a large scale image forming apparatus in which the electrostatic latent image retaining member is of the belt type and the diameter of the developer carrying member is 50 mm or larger. For the image forming apparatus in which the developer carrying member is 30 mm or smaller in diameter and the electrostatic latent image retaining member is 200 mm or smaller in diameter, the pole-to-pole distance is preferably 5 mm or shorter.

* Surface Roughness of the Developer Carrying Member

The surface roughness of the developer carrying member will be described. When the surface roughness is too small in the developing devices of the above-mentioned embodiments, the developer tends to slip when it passes the layer regulating member. The quantity of transported developer varies depending greatly on a toner density in the developer, so that the resultant image density fluctuates. When the surface roughness is too large, it is difficult to control the developer carrying member for stabilizing it. In other words, the image density irregularity tends to occur in accordance with period of the rotation of the developer carrying member.

An experiment was conducted. In the experiment, of the magnetic carriers available for the above-mentioned embodiments, the magnetic carriers having the smallest small average particle diameter, 20 μm, were used. From the experiment, it was seen that when the surface roughness Rx of the developer is 2 μm (10% of the average particle diameter) or larger, the developer little slipped when it passes the layer regulating member. Additionally, the magnetic carriers having the largest average particle diameter, 70 μm, of those available for the embodiments were used. When the surface roughness Rz of the developer carrying member exceeds 50 μm (70% of the average particle diameter of the magnetic carriers), an image density irregular was observed. This was confirmed for the developer carrying members of the first, second and fourth embodiments. Accordingly, use of the developer carrying member of the surface roughness of 50 μm or larger is impracticable. Consequently, the surface roughness Rz preferably ranges from 10% or more of the average particle diameter of the magnetic carriers and 50 μm or smaller (approximately 70% of the average particle diameter 70 μm).

* Magnetic Characteristics of the Developer Carrying Member

The magnetic characteristics of the developer carrying member will be described. In the developer used in the embodiments of the present invention, when the maximum value of an intensity of the magnetic field (flux density) in the vertical direction, developed by each magnetic pole, is smaller than 200 Gauss, carrier dispersion was observed. When it is in excess of 1000 Gauss, the height of the erected developer was too large. Therefore, it is difficult to increase the gap between the developer carrying member and the electrostatic latent image retaining member. Thus, it was confirmed that a practical range of the maximum values of the magnetic field intensity is between 200 Gauss and 1000 Gauss.

* Characteristics of the Carriers of the Developer

The characteristics of the carriers of the developer follows. When the saturation magnetization is less than 20 emu/g, the carriers are easily transferred to the electrostatic latent image retaining member. When it exceeds 70 emu/g, carriers tend to agglomerate on the developer carrying member. Under this condition, it is difficult to form a magnetic brush allowing much toner to fly. Accordingly, it is seen that a preferable saturation magnetization ranges between 20 emu/g and 70 emu/g.

The carriers of the average particle diameter (weight average particle diameter) of smaller than 20 μm are easily transferred to the electrostatic latent image retaining member under the influence of a magnetic force and an electrostatic force, which act on one carrier. When it exceeds 70 μm, the surface area of the carrier is reduced, and the surface area of the magnetic brush with toner attached thereto is also reduced. The result is a poor image density. Accordingly, a preferable range of the average particle diameter (weight average particle diameter) is between 20 μm and 70 μm.

* Characteristics of the Developer

Characteristics of the developer will be described. When the average particle diameter (weight average particle diameter) is 3 μm or smaller, an unsatisfactorily amount of toner emanated from the developing device in the range of charge quantity which ensures a satisfactory amount of development. In the image forming apparatus used in the embodiments, a moving speed of the electrostatic latent image retaining member is 100 mm/sec. At this speed, at least 5 μm is required for the average particle diameter of toner where a small developing device is used. When the average particle diameter of toner exceeds 15 μm, a thin line sharpness of the image and a granuality of the image in the low density region are deteriorated. The image forming apparatuses used in the above-mentioned embodiments are designed with an intention of improving the thin line sharpness and the granuality in the low density region. To this end, the exposure laser beam is pulse width modulated for 256 tones with one pixel of 63.5 μm, and toner for developing it is further fined. For this reason, the average particle diameter of toner is preferably 10 μm or smaller for the image forming apparatuses.

As for the frictional charging with the carriers, it is necessary to set the charge quantity of toner in the range between 5 μc/g and 50 μc/g. If it is below 5 μc/g, toner and carriers are bonded by a weak electrostatic force. Toner is scattered, and a response thereof to the developing electric field is not quick. The reproduction performance of thin lines and at low density is deteriorated. Where the charge quantity of toner is increased, an electrostatic latent image on the electrostatic latent image retaining member is electrostatically saturated at a small amount of toner. Accordingly, a latent image at very high voltage is required in order to secure a satisfactory image density. A method of increasing the coloring force of toner may be used for securing a required image density. In the present embodiments, the optimization has been completed in coloring material dispersion, and the like. Hence, if the amount of the coloring material is doubled, the coloring force is not doubled, simply. Therefore, it is difficult to use a general electrostatic latent image retaining member of the type in which when it exceeds 50 μc/g, the initial charge potential is reduced to 1000 V or lower.

* Other Applications of the Image Forming Apparatus

In the above-mentioned embodiments, the first developing device is a black-color developing device of the magnetic one-component developing type. However, this may be substituted by another suitable developing device.

In a case where a two-component developer is used as in the second, third, and fourth developing devices, and nonmagnetic black toner is used in the noncontact type development where toner is caused to fly in an alternating electric field, the black toner on the electrostatic latent image retaining member is not disturbed by the magnet when it passes the location facing the second, third or fourth developing device. Therefore, the gap between the electrostatic latent image retaining member and the developing roll may be narrowed, and/or the AC electric field containing a DC component may be intensified. Measure can be taken for preventing the image disturbance, securing the required image density and a required image quality, and the like, at an increased design freedom.

A first developing device in which nonmagnetic black toner is developed in a conventional manner that a magnetic brush of a two-component developer is brought into contact with the toner, may have the useful effects as mentioned above. In this case, a retract mechanism for preventing the disturbance of an image after it is developed by the black toner must be used.

As seen from the foregoing description, in the developing device of the present invention, a plural number of portions where the developer is erected toward the electrostatic latent image retaining member are formed in the developing area by a plural number of magnetic poles disposed in the developer carrying member. Therefore, the quantity of toner contributing to the development is increased, and the developing efficiency is improved. Further, an intensive electric field may be developed in the developing area by narrowing the gap between the developer carrying member and the electrostatic latent image retaining member. A satisfactory image density is secured.

What is claimed is:

1. A developing device for developing a latent image formed on an electrostatic latent image retaining member, comprising:

a developer carrying member having a circumferential surface portion for transporting a magnetically attracted two-component developer containing magnetic carriers and nonmagnetic toner disposed facing said electrostatic latent image retaining member, wherein an alternating electric field is formed in a developing area where said electrostatic latent image retaining member faces said developer carrying member, the nonmagnetic toner of the two-component developer, which is kept in noncontact with said developer carrying member, is transferred to said electrostatic latent image retaining member in the alternating electric field, thereby visualizing an electrostatic latent image formed thereon;

a magnet concentrically disposed within said developer carrying member and having an array of magnetic poles of different polarities alternately and circumferentially arrayed at the surface thereof at such a pitch that a plural number of the magnetic polarities are contained in the developing area, and wherein said magnetic pole pitch is established to be longer than a distance between said magnet surface and said developer carrying member surface.

2. The developing device of claim 1, wherein said magnetic poles of different polarities are alternately arrayed at a part of the circumference of said magnet.

3. The developing device of claim 1, wherein said magnetic poles of different polarities are alternately arrayed about the entire circumference of said magnet.

4. The developing device of claim 1, wherein said circumferential portion is a conductive sleeve.

5. The developing device of claim 1, wherein said circumferential portion is a conductive layer on the surface of said magnet.

6. The developing device of claim 5, wherein said conductive layer and said magnet are independently turned.

7. The developing device of claim 1, wherein said circumferential portion and said magnet are combined such that said circumferential portion and said magnet are stuck together and turned in unison.

8. The developing device of claim 1, wherein said developer carrying member has a magnetic field intensity between 200 Gauss and 1000 Gauss.

9. The developing device of claim 1, wherein said magnetic carriers have a saturation magnetization between 20 emu/g and 70 emu/g.

10. The developer device of claim 1, wherein said magnetic carriers have an average particle diameter between 20 μm and 70 μm.

11. The developing device of claim 1, wherein said toner has an average particle diameter between 5 μm and 10 μm.

12. The developing device of claim 1, wherein said toner has a charge quantity range between 5 μc/g and 50 μc/g.

13. The developing device of claim 1, wherein said magnetic pole pitch is smaller than a width of an effective developing area defined by a region in which toners attach to a latent image formed on said electrostatic latent image retaining member when an alternating electric field is applied which is the same as the electric field applied when developing in a state in which said developing carrying member and said electrostatic retaining member are at a standstill.

14. An image forming device comprising at least one non-contact developing device which comprises:

a developer carrying member having a circumferential surface portion for transporting a magnetically attracted two-component developer containing magnetic carriers and nonmagnetic toner disposed facing said electrostatic latent image retaining member, wherein an alternating electric field is formed in a developing area where said electrostatic latent image retaining member faces said developer carrying member, the nonmagnetic toner of the two-component developer, which is kept in noncontact with said developer carrying member, is transferred to said electrostatic latent image retaining member in the alternating electric field, thereby visualizing an electrostatic latent image formed thereon, a magnet concentrically disposed within said developer carrying member and having an array of magnetic poles of different polarities alternately and circumferentially arrayed at the surface thereof at such a pitch that a plural number of the magnetic polarities are contained in the developing area, and wherein said magnetic pole pitch is established to be longer than a distance between said magnet surface and said developer carrying member surface.

15. An image forming device according to claim 14 comprising a plural number of developing devices, wherein one of said developing devices is said non-contact developing device for developing an electrostatic latent image formed in advance on an electrostatic latent image retaining member with toner.

16. A developing device for developing a latent image formed on an electrostatic latent image retaining member, comprising:

a non-magnetic developer carrying member having a circumferential surface portion for transporting a magnetically attracted two-component developer containing magnetic carriers and nonmagnetic toner disposed facing said electrostatic latent image retaining member, wherein an alternating electric field is formed in a developing area where said electrostatic latent image retaining member faces said developer carrying member, the nonmagnetic toner of the two-component developer, which is kept in noncontact with said developer carrying member, is transferred to said electrostatic latent image retaining member in the alternating electric field, thereby visualizing an electrostatic latent image formed thereon wherein a magnet concentrically disposed within said developer carrying member and having an array of magnetic poles of different polarities alternately and circumferentially arrayed at the surface thereof at such a pitch that a plural number of the magnetic polarities are contained in the developing area, and wherein said magnetic poles of different polarities are alternately arrayed about the entire circumference of said magnet.

17. The developing device of claim 16, wherein said circumferential portion is a conductive layer on the surface of said magnet, wherein said conductive layer and said magnet are independently turned.

18. The developing device of claim 16, wherein said circumferential portion and said magnet are combined such that said circumferential portion and said magnet are stuck together and turned in unison.

* * * * *